United States Patent [19]

Miyatuka et al.

[11] 4,105,448

[45] Aug. 8, 1978

[54] ELECTROPHOTOGRAPHIC PHOTOSENSITIVE LAYER AND MARKING METHOD

[75] Inventors: Hajime Miyatuka; Takashi Saida; Satoru Honjo, all of Asaka, Japan

[73] Assignee: Fuji Photo Film Co., Ltd., Minami-ashigara, Japan

[21] Appl. No.: 607,521

[22] Filed: Aug. 25, 1975

[30] Foreign Application Priority Data

Aug. 23, 1974 [JP] Japan ..... 49-96193

[51] Int. Cl.[2] ..... G03G 5/087

[52] U.S. Cl. ..... 96/1.8; 96/1.5 R

[58] Field of Search ..... 96/1.5, 1.8

[56] References Cited

U.S. PATENT DOCUMENTS

| | | | |
|---|---|---|---|
| 3,152,895 | 10/1964 | Tinker et al. | 96/1.8 |
| 3,368,893 | 2/1968 | Garrett | 96/1.8 |
| 3,401,037 | 9/1968 | Roteman | 96/1.8 |
| 3,447,957 | 6/1969 | Behringer | 96/1.8 |
| 3,519,421 | 7/1970 | Cheng | 96/1.8 |

FOREIGN PATENT DOCUMENTS

| | | | |
|---|---|---|---|
| 42-18,676 | 9/1967 | Japan | 96/1.5 |

*Primary Examiner*—Roland E. Martin, Jr.
*Assistant Examiner*—John L. Goodrow
*Attorney, Agent, or Firm*—Sughrue, Rothwell, Mion, Zinn and Macpeak

[57] ABSTRACT

An electrophotographic photosensitive layer comprising finely divided photoconductive powders and a resin binder comprising a mixture of an acrylic resin and an epoxy ester resin in a ratio by volume of the acrylic resin to the epoxy ester resin of about 10:90 to 70:30; and an electrophotographic marking method suitable for use on substrates subsequently machined comprising electrophotographically marking machining information on a coating film, forming on a support to be machined, of the electrophotographic photosensitive layer as defined above and hardening the coating film.

12 Claims, No Drawings

ELECTROPHOTOGRAPHIC PHOTOSENSITIVE LAYER AND MARKING METHOD

BACKGROUND OF THE INVENTION

1. Field of the Invention

This invention relates to an electrophotographic photosensitive layer, and more particularly to an improvement in the performance of an electrophotographic photosensitive layer through improving the composition of the resin binder.

2. Description of the Prior Art

As the photosensitive layer used in conventional electrophotography involving the steps of a uniform charging of a photosensitive layer formed on a support, toner developing and fixing to produce toner images, a variety of types of photosensitive layers are known in the art which include, for example, a photosensitive layer in the form of a coating film, which comprises a uniformly mixed system of finely divided photoconductive powders and a resin binder; photoconductive metals as represented by selenium; a photosensitive layer comprising a vapor-deposited film of an alloy; and a continuous film of a photoconductive organic polymer as represented by polyvinylcarbazole.

Of the above enumerated photosensitive layers, a photosensitive layer in the form of a coating film, which comprises a uniformly mixed system of finely divided photoconductive powders and a resin binder, is most generally used because of the relative ease of its preparation, its low cost, and the ease in improving its properties.

Electrophotography is now widely applied in practice in varied reprinters such as those commercially available under the trade names of Electrofax ® (RCA) and Xerox ® (Xerox Corporation) reprinters.

On the other hand, a processing method comprising forming an electrophotographic photosensitive layer on a material to be processed, marking, in an electrophotographic manner, machining information on the layer and conducting different machining operations on the material in accordance with the machining information is also employed in practice, known commercially as the Electro-Print-Marking (EPM ®; Fuji Photo Film Co., Ltd.) process.

Also, as the photosensitive layer for use in the EPM ® process photosensitive layers of the powder dispersion type are widely used. These layers comprise, predominantly, finely divided photoconductive powders, especially finely divided zinc oxide powders, and a resin binder. The reasons for this are that their preparation is relatively easy; that the production cost is low; that it is easy to improve their properties; that their photosensitivity is appropriate for practical use; and that white photosensitive layers are obtainable, etc.

In the EPM ® process, different machining is conducted after electrophotographic marking. Machinings conducted include mechanical, discharge, or electrolytic machining. As a consequence, the photosensitive coating film layer formed on a support, which is also the material to be machined, must have a high degree of processing resistance. Thus, in machining on a milling cutter or in drilling with a drill, the photosensitive layer must not be softened by frictional heat generated between the cutting tool and the material to be machined; the photosensitive coating film must not delaminate from the material due to poor adhesion to the support; the photosensitive layer, should the layer be softened, must not become sticky, in order that chips from the support do not embed in and adhere to the softened areas of the layer which would otherwise impair the other areas of the layer; and that, in electrodischarge machining, when treated in an insulating liquid such as kerosene, the toner images marked on the photosensitive layer must not be impaired through swelling or dissolving. However, most resin binders used in electrophotographic photosensitive layers are of relatively low molecular weight, and, therefore, have lower softening points. Furthermore, since the proportion of the resin in the composition in the photosensitive layer is low and the photosensitive powders occupies a high proportion of the layer, the adhesion with the support cannot be expected to be too high.

Moroever, in the EPM ® process, a photosensitive layer is formed on a support which is a material to be machined, on the spot where the material is machined. In usual cases, a paintlike coating composition comprising, predominantly a resin, photoconductive powders and a solvent, is applied onto a support having an unspecified shape and an unspecified dimension to form a photosensitive coating film thereon. As a consequence, after forming the photosensitive coating film formed on the support by coating, it is preferred for image formation to become possible as soon as possible. In general, immediately after the coating, that is, before the applied coating film has sufficiently dried, the charging capacity of the photosensitive layer is low and the charge retention thereof is also low. This results in a low charge potential and in a high speed of potential attenuation in the dark. For these reasons satisfactory images are not obtainable before sufficient drying has occurred. As drying proceeds the charging response improves and in some cases drying by heating becomes necessary. However, in practical use, a highpower drying device is not desired. In addition, when the photosensitive layer coated on the support is charged and imagewise exposed without sufficient drying, the charge dissipation is in general not complete in the exposed areas. As a result, fogging tends to occur upon toner development.

As described in the foregoing, especially in the EPM ® process, photosensitive layers are desired in which the coating films have high machining resistance and produce satisfactory toner images by relatively simple drying treatment, within a short period of time after application.

In the case of photosensitive layers for use in reprinters, a long period of time lapses from the formation of the photosensitive layers to the actual use of them by the ultimate users, during which period of time sufficient drying is achieved and the electrical properties are enhanced. The matters as described above for the photosensitive layers for EPM ® offer no problem in this case.

If it were to become possible, in the EPM ® process, to conduct the image forming treatment within a short period of time after formation of the photosensitive layer, a lot of advantages would be achieved, for example, the flow of materials would not be retarded on the spot where the machining is actually carried out, and in marking treatment, automatic handling from carrying in to carrying out of the materials to be machined becomes possible.

SUMMARY OF THE INVENTION

An object of the present invention is to provide an electrophotographic photosensitive layer having a high degree of machining resistance.

Another object of the present invention is to provide an electrophotographic photosensitive layer whereby a high degree of charge retention is achievable by a relatively simple drying treatment, within a short period of time after the application of the layer on a support.

Still another object of the present invention is to provide an electrophotographic photosensitive layer whereby toner images without fog are obtainable when an image forming treatment is conducted within a short period of time after formation of the layer on a support, through a relatively simple drying treatment.

As the result of research, the above enumerated objects of the present invention have been found to be attainable by the process as specified hereunder.

Thus, the above described objects of the present invention are accomplished by an electrophotographic photosensitive layer comprising, predominantly, finely divided photoconductive powders and a resin binder, wherein the resin binder is a resin mixture of an acrylic resin and an epoxy ester resin in a ratio by volume of the acrylic resin to the epoxy resin ranging from about 5:95 to about 70:30.

DETAILED DESCRIPTION OF THE INVENTION

As the finely divided photoconductive powders, powders of a variety of photoconductive substances as described in, for example, U.S. Pat. Nos. 2,598,732, 2,599,542, 2,727,807, and 2,727,808 are suitable, for example, zinc oxide, titanium oxide, leas oxide, cadmium sulfide, zinc sulfide, cadmium sulfide-cadmium carbonate complex ($CdS.nCdCO_3$, $n = 1$ to 4), cadmium selenide, phthalocyanine pigments, azo pigments, quinacridone pigments, etc. Above all the use of zinc oxide is preferred from the standpoint of performance and economy. A suitable particle size of the finely divided photoconductive powders can range from about 0.05 to 0.5 $\mu$.

Suitable acrylic resins are those copolymers of an acrylic acid ester or methacrylic acid ester with at least one copolymerizable monomer selected from the group consisting of crotonic acid, acrylic acid, itaconic acid, maleic anhydride, methyl methacrylate, ethyl methacrylate, n-butyl methacrylate, ethyl acrylate, butyl acrylate, a hydroxyalkyl (meth)acrylate, a dihydroxyalkyl (meth)acrylate, an aminoalkyl (meth)acrylate, a dialkylaminoalkyl (meth)acrylate and styrene. In addition, it is also advantageous to use in the present invention those polymers as described in Japanese Patent Publication No. 17316/1969 and German Pat. No. 1,522,562, including, for example, a hydroxyalkyl acrylate or, methacrylate and a glycidyl acrylate or methacrylate.

More specifically, these acrylic ester copolymers can be characterized as containing a monoester from an aromatic dicarboxylic acid and a hydroxyalkyl (meth)acrylate. Suitable specific examples of (meth)acrylates which can be employed are those which have 1 to 20 carbon atoms in the alkyl moiety thereof and include 2-hydroxyethyl (meth)acrylate, 2-hydroxypropyl (meth)acrylate, 3-hydroxypropyl (meth)acrylate, 4-hydroxybutyl (meth)acrylate, 5-hydroxyamyl (meth)acrylate, 6-hydroxyhexyl (meth)acrylate, 7-hydroxyheptyl (meth)acrylate, 8-hydroxyoctyl (meth)acrylate, 9-hydroxynonyl (meth)acrylate, 10-hydroxydecyl (meth)acrylate, etc.

Furthermore, it is also possible to employ the particular acrylic esters as described in Japanese Patent Publication Nos. 18497/1973, 34183/1973, 32735/1973 and 8557/1973. The acrylic ester copolymers described in the above recited patent references can be characterized as containing the following repeating unit:

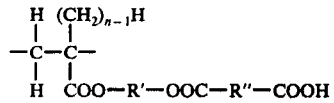

wherein $n$ is 1 or 2; R′ is a ($C_2$-$C_{10}$) alkylene group; and R″ is

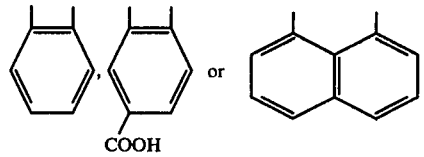

In acrylic copolymers in general, an aromatic ring is present in the form of styrene or a styrene derivative and an acid component in the form of acrylic acid, methacrylic acid, maleic anhydride or the like.

The acrylic resins used in the present invention have a molecular weight of about 1,000 to 50,000 and have preferably a Tg value ranging from about 10° to 100° C.

Refering now to the epoxy ester resins, these resins are products obtained on esterification of an epoxy resin having at least two terminal epoxy groups with a fatty acid, with the epoxy resin being represented by the reaction product of epichlorohydrin and a polyhydric phenol such as bis(4-hydroxyphenyl)dimethylmethane. In general, suitable fatty acids which can be used have 8 to 22 carbon atoms and the degree of unsaturation thereof as measured by the iodine value is about 100 or higher. Suitable fatty acids employed in the present invention include, linseed oil fatty acid, dehydrated castor oil fatty acid, soybean oil fatty acid, castor oil fatty acid, coconut oil fatty acid and the like, as well as such fatty acids modified with a vinyl monomer such as styrene or an acrylic ester. In addition, for a variety of purposes, e.g., for accelerating the hardening, the drying of the electrophotographic photosensitive layer according to the present invention, or increasing the melting point thereof, etc., rosin, tall oil, dimer acid, maleic anhydride or the like can be used together in an amount of 5 to 6% by weight to the total amount of the fatty acid employed.

A preferred example of an epoxy resin used in the preparation of epoxy ester resins is the condensation product of Bisphenol A and epichlorohydrin, having an epoxy equivalent of from about 400 to 4,000, most desirably from 400 to 1,000.

The oil length (the proportion, in % by weight, occupied by the fatty acid) in general ranges from about 25 to 70% by weight, although a particularly preferred range is from 35 to 50% by weight. In those epoxy ester resins having a longer oil length, the compatibility with the acrylic resin becomes extremely poor, and problems in the mechanical properties, especially hardness of the resultant film occur. A fatty acid having a degree of unsaturation (as measured by the iodine value) which is not too low is preferably used in the present invention. On the contrary, using an aliphatic acid having a low unsaturation degree can not be used to achieve the objects of the present invention because of the lack of hardening of the epoxy ester resin. Accordingly, the fatty acids, employed in the epoxy resin of the present invention, having an iodine value of about 50 or more, preferably 70 or more, particularly preferably 100 or more, such as linseed oil fatty acid, dehydrated castor oil fatty acid, soybean oil fatty acid, tall oil fatty acid, safflower oil fatty acid, perilla oil fatty acid, tung oil fatty acid etc. can be employed. Furthermore, in these resins, the dependence upon moisture of the electrophotographic properties of the electrophotographic photosensitive layer increases, and solvent (carrier liquid for liquid developer) resistance before completion of hardening is poor. On the other hand, in those epoxy ester resins having a shorter oil length, the resultant film tends to be too brittle and the dependence upon moisture of the electrophotographic properties increses again.

The two kinds of resins used in the present invention have poor compatibility with each other, and considerable turbidity occurs when the two solutions are mixed with each other. When they are employed in the form of a coating composition, however, an unexpected stability as will be described in detail hereinafter is exhibited, and the resultant coating film has a very high mechanical strength.

A composition for coating an electrophotographic photosensitive agent, which composition comprises a mixture of finely divided photoconductive powders and a resin binder, can be prepared in the following manner. A resin mixture of the above described acrylic resin and epoxy ester resin, finely divided photoconductive powders, solvents for the resins (e.g., toluene, xylene, butyl acetate, ethyl acetate, etc.), and additives (e.g., sensitizing dyes, for example, in an amount of about 0.05 to 0.01% by weight based on the total amount of ZnO employed) are admixed together and kneaded well in a kneading and dispersing device such as a ball mill, a sand mill, a roll mill, an attritor, or a vibrating mill to assure a uniform dispersion of the finely divided photoconductive powders.

The resultant coating composition is then applied onto a support. The application is made, if necessary, after adding to the coating composition a further amount of solvent to reduce the viscosity of the composition using any suitable coating means, such as an air doctor coater, a blade coater, a rod coater, a squeeze coater, a reverse roll coater, a spray coater or the like.

After the application, the coating film is dried. The drying is preferably conducted until the coating film has a sufficient charge potential as an electrophotographic photosensitive layer. If necessary, drying by heating to about 20 to 80° C can be employed using a suitable drying device.

In this way an electrophotographic photosensitive layer is formed on a support.

In the photosensitive coating film layer obtainable in accordance with the present invention, in general 30 minutes of drying at normal temperature (about 20° C) is sufficient.

With respect to the mixing of the acrylic resin and the epoxy ester resin, the resins may be admixed together, prior to admixing with the finely divided photoconductive powders, effected by kneading and dispersing, or otherwise each of the resins can be added separately upon kneading and dispersing.

The compatibility between the acrylic resins and the epoxy ester resins is in general not very good. As a consequence, the stability of mixtures of these resins tends to decrease with time, with a phase separation occurring. Quite unexpectedly, however, in the uniform powders-resin composition of the present invention obtained by admixing finely divided photoconductive powders, more precisely, a relatively large amount (as will be specified hereinafter) of such powders with the resin mixture, no lack of stability with time as found in the mixture of the resins occurs, and a composition containing an electrophotographic photosensitive agent is obtainable, which exhibits an extremely high stability with time. This fact is a characteristic feature of the present invention. Although the theoretical basis for this is not at present completely clear, it is believed that this might result, for example, from the presence of an extremely high proportion of powders in the composition of the electrophotographic photosensitive agent, and/or from high affinity in general of epoxy ester resins for finely divided photoconductive powders.

The mixing ratio of the resin components to the finely divided photoconductive powders, in terms of a ratio, by volume, of the nonvolatile portion of the resin to the finely divided photoconductive powders, ranges from about 75:25 to 20:80, more preferably from 65:35 to 25:75, particularly preferably from 60:40 to 30:70.

When the amount of the resin is too high, the electric potential in the image-wise exposed areas is not reduced and therefore a considerable residual electric potential forms, which results, upon toner development, in an increased fog density and, thereby, in a degradation of the quality of the resultant images.

Conversely, when the amount of the resin too low, in other words, when the amount of the finely divided powders is too high, the mechanical strength, as well as the adhesion to metals, of the electrophotographic photosensitive layer decreases, which results in a degradation of the machining resistance and also in a reduction of charge potential and in an accerelation of the attenuation rate of the potential. Furthermore, the moisture resistance of the layer is also reduced, which leads, in the case of operations under high moisture conditions, to a degradation of the electrophotographic performance.

The mixing ratio of the acrylic resin to the epoxy ester resin, in terms of a ratio, by volume, of the nonvolatile portion of the acrylic resin to that of the epoxy ester resin, ranges from about 10:90 to 70:30, preferably from 15:85 to 60:40, particularly preferably 20:80 to 50:50.

When the amount of the epoxy ester resin is not sufficiently low, the processing resistance of the photosensitive layer is reduced and therefore the objects of the present invention are not sufficiently achieved. Thus, in such cases, even if a hardening treatment is conducted adequately after image formation, the adhesion to metal supports, heat resistance and kerosene immersion resistance will not be enhanced to a satisfactory degree. Furthermore, the affinity between the resin binder and the finely divided photoconductive powders is reduced, so that the powders are not dispersed well and it becomes difficult to obtain an evenly coated film of the photosensitive layer.

Conversely, when the amount of the acrylic resin is too low, the film layer does not charge well unless the layer is dried over a long period of time after formation of the film layer. Moreover, in such cases, the layer does not have a high charge retention, so that satisfactory toner images are not obtainable. Furthermore, a large amount of residual charge exists after exposure and therefore a highly fogged toner image results, it thus being impossible to accomplish the objects of the present invention.

In order to fully achieve the objects of the present invention, a metal salt, such as cobalt, manganese or lead stearate, naphthenate or octenate, as hardening catalyst, is preferably incorporated into the photosensitive layer. In general the use of 0.05% by weight based on the epoxy ester resin of the hardening catalyst is sufficient.

Care should be taken so that the dispersion is not excessive. Thus, excessive dispersion may cause a destruction of the photoconductive powders adversely affecting their crystallinity. This results in a degradation of the electrophotographic performance of the resultant electrophotographic photosensitive layer.

It is also possible to add sensitizing dyes, for example, in an amount of about 0.05 to 0.01% by weight based on the total amount of ZnO employed, for finely divided photoconductive powders, and/or optical fatigue inhibitors, such as salts of metals (e.g., manganese, cobalt, copper or nickel) in an amount of, for example, about 0.5 to 0.1% by weight to the amount of ZnO employed, to the layer composition.

Metals or paper sheets, synthetic resin films or wooden materials whose surface has been so treated as to render it electroconductive are examples of suitable support materials.

It is also effective, for enhancing the adhesion to metal supports, kerosene immersion resistance and heat resistance of the electrophotographic photosensitive layer, to heat the layer, in combination with the incorporation thereinto of metal salts such as cobalt or manganese salts. A suitable temperature for the heat treatment can range from about 30° C to 100° C. The treating time depends upon the temperature used, that is, the use of the higher temperature requires a shorter treatment time. For example, at a film thickness of 10 $\mu$, a 10 hour and a 2 hour-treatment suffice at 30° C and 60° C, respectively.

The amounts of the epoxy ester resin and acrylic resin, in addition to being defined by the above described mixing ratio of the two resins and by the mixing ratio of the finely divided photoconductive powders and resin binder, are also defined by another important factor, the % content of the respective resins in the electrophotographic photosensitive layer. Thus, if an electrophotographic photosensitive layer is to comprise, predominantly, finely divided photoconductive powders and a resin binder, it has been found necessary to achieve the objects of the present invention for the epoxy ester resin to be present in the electrophotographic photosensitive layer in an amount ranging from about 10 to 65, preferably from 20 to 60, particularly preferably from 25 to 55, % by volume.

Too high a content of the epoxy ester resin in the electrophotographic photosensitive layer may lead to a reduction in the moisture resistance. Conversely too low a content of the epoxy ester resin may result in a reduction of the adhesion to metal supports, kerosene immersion resistance or heat resistance of the photosensitive layer. In either case, therefore, the objects of the present invention cannot be achieved well.

The acrylic resin content in the electrophotographic photosensitive layer ranges from about 45 to 3, preferably from 35 to 6, particularly preferably from 30 to 8, % by volume.

Too high an acrylic resin content may result in a reduction of the adhesion to metal supports, kerosene immersion resistance and heat resistance of the photosensitive layer. Conversely, when the content is too small, a satisfactory charging response will not be obtained unless a considerably intensive drying treatment is conducted after application, for example, using heat drying, and furthermore the optical fatigue effect increases due to preexposure. Thus, in either case, it is impossible to achieve the objects of the present invention well.

As described in the foregoing, in the present invention, the amount of the resin components incorporated in the electrophotographic photosensitive layer is a quite important factor. The amount is determined by the mixing ratio of the epoxy ester resin and the acrylic resin, by the mixing ratio of the resin binder to the finely divided photoconductive powders, and by the content of each of the epoxy ester resin and the acrylic resin in the photosensitive layer.

An advantage of the electrophotographic photosensitive layer in accordance with the present invention is that the layer has excellent adhesion to metals.

As a consequence, in applying the EPM ® process to the processing of a metal material, delamination of the photosensitive layer from the edge portion being processed will not occur upon cutting or electrodischarge machining, due to a high adhesion of the electrophotographic photosensitive layer to the metal support being machined. It is therefore possible to conduct machining without the marked lines being effaced.

Another advantage of the photosensitive layer in accordance with the present invention is that the layer has high kerosene immersion resistance.

As a consequence, in applying the EPM ® process to electrodischarge machining of a metal material, the photographic photosensitive layer in accordance with the present invention, when immersed in a processing bath for electrodischarge machining over a long period of time, will not be removed from the surface of the support by being swollen or dissolved by the action of the kerosene bath liquid. It therefore becomes possible to conduct electrodischarge machining of a metal material on the marked information expressed on the electrophotographic photosensitive layer with lay-out lines.

Still another advantage of the electrophotographic photosensitive layer in accordance with the present invention is that the layer has excellent heat resistance.

As a consequence, when, in applying the EPM ® process to machining a metal material, the temperature of the support material increases as a result of heat generation taking place, for example, upon machining between a cutting tool and the material to be machined or upon electrodischarge machining through discharge between the electrodes and the material to be machined, and the electrophotographic photosensitive layer will not be softened nor swollen. Thus, the electrophotographic photosensitive layer other than the machined areas will not be impaired by cutting, and the machining work can be done under good conditions. This is in particular so when the material to be machined is a hard material such as a structural profile.

Of the many advantages of the present invention, the above enumerated ones are due to the effect of the epoxy ester resin.

Another advantage of the photosensitive layer in accordance with the present invention is that excellent electrophotographic properties are achieved in the layer by an extremely simple drying treatment, within a relatively short period of time after application.

Thus, after forming a coating film on a support, when a drying treatment is conducted for 30 minutes or longer in the case of drying at normal temperature (15° to 25° C) or for 10 minutes or longer in the case of heat drying, the electrophotographic photosensitive layer of the invention can be sufficiently charged with the electric potential attenuation being rendered sufficiently slow for practical use.

This advantage is of particularly practical value in the EPM ® process, where the coating is applied just before use and metals having a large heat capacity and a high thermal conductivity are frequently used as the support. Although this advantage seems to be attributable mainly to the effect of the acrylic resin, the electrophotographic photosensitive layer of the invention using a mixed resin often shows superior properties to those of an electrophotographic photosensitive layer comprising an acrylic resin alone. Thus, in the electrophotographic photosensitive layer using an acrylic resin as the resin binder, only a quite low initial charge potential is attainable, in comparison to the electrophotographic photosensitive layer using an epoxy ester resin alone as the resin binder, by application of normal temperature drying over a relatively short period of time. On the other hand, in the case of the epoxy ester resin, the initial charge potential is quite high under the same conditions, although the attenuation rate of the electric potential is significantly high, often to such an extent that the layer cannot be practically used. While, in the case of the mixture of the two resins in accordance with the present invention, a high initial charge potential and a slow electric potential attenuation, that is, the advantageous properties of the respective resins, are obtainable by a simple normal temperature drying. Thus, it has been found that the resultant properties are more than a simple addition of the properties from the acrylic resin and those from the epoxy ester resin. In addition, the drying response of the electrophotographic photosensitive layer is sufficiently enhanced in a relatively low mix ratio of the acrylic resin. Thus, the above described effect is obtainable by incorporation of as little as about 5% by weight of the acrylic resin into the resin binder. This is a result which would not be predictable from a simple knowledge of the properties of the acrylic acid and those of the epoxy ester resin. Rather, it is to be considered a super-synergistic effect achieved by the combination of the two resins, which effect has been discovered for the first time.

The above described extraordinary effect of the combination of the acrylic and epoxy ester resins brings about the following advantages: high moisture resistance and minimization of the optical fatigue effect due to pre-exposure.

Although both of the advantages seem to be atributable mainly to the effect of the acrylic resin, they appear at a relatively low mix ratio of the acrylic resin, which is an unexpected fact constituting a part of the novelty of the present invention. The above described two advantages are of especially great value in the practice of the EPM ® process. Thus, in marking a relatively heavy structural member using the EPM ® process, the marking of the member to be marked and the machining of the marked member are, in most cases, conducted in a building under conditions which approximate outdoor conditions. In other words since the heavy member to be marked is generally conveyed by a crane, one side of the building may be considered to be always open. As a consequence, for the electrophotographic photosensitive layer, high moisture resistance as well as minimized optical fatigue due to preexposure is required.

As described in the foregoing, the electrophotographic photosensitive layer in accordance with the present invention gives rise to important advantages when employed in the EPM ® process. The advantages become much greater especially when cutting or electrodischarge machining is employed after marking.

Thus, the photosensitive layer in accordance with the present invention contains finely divided photoconductive powders in a well dispersed form and has even surface, and, moreover, the toner images thereon have a fine texture. Such advantages will result in advantageous conditions in employing the EPM ® process in precise cutting.

Also an important advantage of practical value of the present invention is that the above described characteristics of the electrophotographic photosensitive layer of this invention, which could not be achieved with the prior art electrophotographic photosensitive layer, can be achieved by the simple operation of merely admixing the two resins together.

It should be also noted that the present invention is advantageous economically, since acrylic and epoxy ester resins are relatively inexpensive and are readily available resins.

A coloration and/or a sensitivity adjustment of the photosensitive layer of the present invention can also be achieved by introducing finely divided non-photoconductive powders into the layer. For example, materials which are quite white e.g., silica, alumina, MgO, $Al_2O_3$, $CaCO_3$, $CaSiCO_3$, talc, chromium oxide or the like can be incorporated in an amount of about 2 to 20% by volume, based on the total powder content.

In addition, it is understood that the above enumerated characteristics and advantages of the present invention apply not only to the EPM ® process, but also to other electrophotographic techniques in general, for example to electrophotographic reproduction techniques.

In general, the compatibility of most combinations of epoxy ester resins and acrylic resins is small and admixing the two resins does not result in uniform mixtures. As a consequence, when a uniformly dispersed photosensitive composition is prepared by dispersing finely divided photoconductive powders in such a mixture, there is a concern with respect to stability with time. Unexpectedly, however, it has been now found that the lack of compatibility between the two resins does not adversely influence the stability with time of the resultant photosensitive composition. This is an extremely noteworthy fact attained by the present invention.

In comparison with acrylic resins, epoxy ester resins, in general, have extremely high affinity to zinc oxide powders. It is therefore considered that, in the photosensitive composition, the high affinity between the epoxy ester resin and zinc oxide powders contributes to the stability and uniformity of the entire system. It is quite probable that in the resin binder-zinc oxide-dispersion system the affinity between the epoxy ester resin and zinc oxide is increased even more due to the poor compatibility between the epoxy ester resin and the acrylic resin.

The use as binder of a mixture of resins having a low compatibility with a view toward improving the properties of an electrophotographic photosensitive layer is described in U.S. Pat. No. 3,378,370. The disclosure also is that, in comparison with the use of the respective resins alone, a higher sensitivity of the electrophotographic photosensitive layer is obtained by the use of a mixture of the resins. In the present invention, however, although the combination of the acrylic resin and the epoxy ester resin has poor compatibility, such improvement in sensitivity is not exhibited, that is, the sensitivity varies, in most cases, on an additive basis in accordance with the mixing ratio of the two resins.

Such difference between the prior art technique and the present invention supposedly arises from a difference in the condition of resin in the electrophotographic photosensitive layer. Although such is not completely clear at this point in time, it is believed that the compatibility between the acrylic resin and the epoxy ester resin may, in general, not be sufficiently low to satisfy the objects described in the above Japanese Patent Publication No. 835/1969, or that, as described before, due to the high affinity between the epoxy ester resin and the finely divided photoconductive powders, the resins may, in the presence of the finely divided photoconductive powders, exist in a different condition in the photosensitive layer from that found in a composition consisting exclusively of the resins.

The present invention will be described in greater detail by the following Examples and Comparative Examples. Unless otherwise indicated herein, all parts, percents, ratios and the like are by weight.

The operations employed in Examples 1 through 7 and Comparative Examples 1 through 4 were as follows:

| Composition for Forming Photosensitive Layer |
|---|
| Finely-Divided Photoconductive Powder: Zinc oxide "Sazex 2000"[200] (manufactured by Sakai Kagaku Co., Ltd.) ——100 parts by volume |
| Resin Binder: Mixed varnish of an epoxy ester resin varnish* and an acrylic resin varnish** ——100 parts by volume based on the non-volatile portion of the resins |
| Diluent: Toluene ——about 350 parts by volume |

*Epoxy Ester Resin Varnish: 50% by weight solution of "Epicosol 801"[200] (manufactured by Nippon Coating Co., Ltd.) modified with dehydrated castor oil in xylene; oil length 40%.

**Acrylic Resin Varnish: 50% by weight solution of a terpolymer of 80 parts by weight n-butyl methacrylate, 20 parts by weight methyl methacrylate and 0.5 parts by weight acrylic acid in toluene/isopropanol as (90/10 by volume) a solvent.

The above composition was placed in a stainless steel container of about a 10 liter capacity and stirred and mixed well therein using a motor stirrer. The mixture was then placed in a ball mill, where kneading and dispersing were conducted for about 10 hours.

After the kneading and dispersing treatment, the resultant dispersed composition was diluted with toluene and cobalt naphthenate was added in the form of a solution in toluene. The dispersed composition was then applied to steel for use as a metal mold for hot molding (500 mm length × 200 mm width × 300 mm height; Japanese Industrial Standards No. SKD-61) by spray coating using a spray gun to form a coated film of an electrophotographic photosensitive layer, having a dry film thickness of about 10 μ.

After being allowed to stand in the dark for about 10 minutes at normal temperature (about 20° C) and humidity (35% R.H.), the film was charged using a corona discharge at a charging voltage of 6 KV. The initial charge potential ($V_O^D$) and the retention of residual potential one minute after the charging ($V_{60}^D/V_O^D$) were measured using a rotating sector-type surface electrometer.

Furthermore, immediately after the charging, an optical exposure of 600 lux for 2.5 sec (=1500 lux-sec) was applied, and the residual potential ten seconds after the exposure ($V_R$) was measured to determine the retention of residual potential after the exposure ($V_R^D/V_O^D$).

An image-wise exposure was then applied, followed by development with a liquid developer for use in a "Denshi Copistar" ® (a reprinter manufactured by Mita Kogyo Co., Ltd.)

After development, hot air, at a temperature at the photosensitive layer surface of 60° C, was fed to effect a hardening treatment for about 8 hours.

Subsequently, the steel material was milled along the developed lay-out lines. An end mill with two cutting edges corresponding to Japanese Industrial Standards No. M-20 was used as the cutting tool.

Furthermore, this steel material was immersed for over 16 hours in kerosene heated to about 80° C, after which the kerosene on the surface was wiped away. Immediately thereafter, that is, before the kerosene had completely dried, the pencil hardness test according to Japanese Industrial Standards No. D0202 (the general test for coatings for use in parts of automobiles) was conducted to test the kerosene immersion resistance.

Separately, an electrophotographic photosensitive layer having the same composition was coated on an aluminum plate (100 mm × 100 mm) of a thickness of about 2 mm and the coated plate was allowed to stand at 20° C and 80% R.H. for about 30 minutes, after which the initial charge potential $(V_O^D)_H$ was measured to test for moisture resistance.

In addition, a pre-exposure of about 600 lux for 4 sec (2400 lux-sec) was applied using radiation from a tungsten lamp to measure the then initial charge potential ($V_O^L$), and by comparing the potential to $V_O^D$, that is by the $V_O^L/V_O^D$ ratio, the degree of optical fatigue due to the pre-exposure was evaluated. The measurement was conducted under the same conditions as the measurement of $V_O^D$, and $V_{60}^D/V_O^D$.

The mix ratio, by volume, of the non-volatile portions of the epoxy ester resin and the acrylic resin used as resin binder was as follows:

| | Acrylic Resin/Epoxy Ester Resin (ratio of nonvolatile portions) |
|---|---|
| Comparative Example 1 | 0/100 |
| Comparative Example 2 | 5/95 |
| Example 1 | 10/90 |
| Example 2 | 15/85 |
| Example 3 | 20/80 |
| Example 4 | 30/70 |
| Example 5 | 50/50 |
| Example 6 | 60/40 |
| Example 7 | 70/30 |
| Comparative Example 3 | 85/15 |
| Comparative Example 4 | 100/0 |

The results of measurement of the various properties are shown in Table 1 below.

Table 1

| Example No. | $V_O^D$ (volts) | $V_{60}^D/V_O^D$ | Milling Resistance[1] | Kerosene Immersion Resistance[2] | $(V_O^D)_H$ (volts) | $V_O^L/V_O^D$ | $V_R/V_O^D$ | Acrylic Resin/ Epoxy Ester Resin (ratio of nonvolatile portions) |
|---|---|---|---|---|---|---|---|---|
| Comparative Example 1 | −165 | 0.22 | O | O | −85 | 0.94 | 0.38 | 0/100 |
| Comparative Example 2 | −205 | 0.46 | O | O | −110 | 0.92 | 0.36 | 5/95 |
| Example 1 | −310 | 0.68 | O | O | −190 | 0.96 | 0.22 | 10/90 |
| Example 2 | −350 | 0.75 | O | O | −220 | 0.92 | 0.18 | 15/85 |
| Example 3 | −415 | 0.86 | O | O | −230 | 0.91 | 0.13 | 20/80 |
| Example 4 | −575 | 0.92 | O | O | −285 | 0.82 | 0.08 | 30/70 |
| Example 5 | −615 | 0.86 | O | O | −370 | 0.65 | 0.06 | 50/50 |
| Example 6 | −620 | 0.85 | O | Δ | −315 | 0.52 | 0.05 | 60/40 |
| Example 7 | −580 | 0.79 | Δ | Δ | −325 | 0.44 | 0.02 | 70/30 |
| Comparative Example 3 | −355 | 0.72 | X | X | −310 | 0.38 | 0.03 | 85/15 |
| Comparative Example 4 | −280 | 0.55 | X | X | −250 | 0.40 | 0.02 | 100/0 |

[1]Milling Resistance:
O — No impairment in areas other than milled areas;
Δ — Some delamination of photosensitive layer in milled edge portions (but not so much as to be impractical);
X — Significant impairment in areas of coating film other than milled areas.
[2]Kerosene Immersion Resistance:
O — No impairment of photosensitive coating film layer;
Δ — Some impairment of photosensitive coating film layer;
X — Significant impairment of photosensitive coating film layer.

It can be seen from the resultant $V_O^D$ and $V_{60}^D/V_O^D$ values, which are indicative of the charging response within a short period of time after formation of the photosensitive layer, that at higher epoxy ester resin: acrylic resin ratios, especially in Comparative Examples 1 and 2, a smaller amount of charge ($V_O^D$) results and in particular the charge retention ($V_{60}^D/V_O^D$) is significantly low. This indicates that the resultant electrophotographic properties are not satisfactory from a practical point of view. When, conversely, the acrylic resin: epoxy ester resin ratio is too high (see Comparative Examples 3 and 4), the values for $V_O^D$ and $V_{60}^D/V_O^D$ decreased again, but not to such an extent as in Comparative Examples 1 and 2. Overall, it can be concluded from this that if a higher charging response is to be attained after formation of the electrophotographic photosensitive layer of the invention, and more precisely within a short period of time after application of a photosensitive layer coating, the mixing ratio of the epoxy ester resin and the acrylic resin, both used as a binder for the layer, should not be too high. In accord therewith, satisfactory results are shown in Examples 1 through 7.

With regard to machining resistance, both the milling resistance and kerosene immersion resistance are low when the acrylic resin: epoxy ester resin ratio is too high. Preferred proportions of the acrylic resin are 30%, preferably 40% for milling resistance, and 30%, preferably up to 50% for kerosene immersion resistance.

Electrodischarge machining was conducted with the sample used in Example 4 in accordance with the marked machining information and no problems from a practical point of view were observed.

Almost the same results as in the milling were obtained when drilling was conducted with a drill.

It can be also seen from the table that $(V_O^D)_H$, which is indicative of the electrophotographic moisture resistance, that the moisture resistance of the photosensitive layer is significantly adversely affected when the proportion of the epoxy ester resin is too high.

At higher proportions of the epoxy ester resin, especially in Comparative Examples 1 and 2, the degree of charge retention upon exposure after formation of a coating of the photosensitive layer, that is, within a short period of time after application of a coating of the photosensitive layer, the ($V_R/V_O^D$) is quite high and there is a very high tendency toward fogging. In other words, there is a much lower sensitivity. At higher proportions of the epoxy ester resin, the value of $V_R$ is not as large at high $V_R/V_O^D$ ratios, because the value of $V_O^D$ is small. In such proportions, however, further increasing the amount of exposure results in little acceleration of electric potential attenuation. Thus, to provide an exposure (precise exposure) which will substantially eliminate fogging, an exposure time of six to seven times longer than that in Examples 1 through 7 was found to be necessary.

From the aforementioned results of Comparative Examples 1 through 4 and Examples 1 through 7, the following conclusions can be drawn. For attaining coatings of a photosensitive layer having working resistance and for improving the optical fatigue tendency due to pre-exposure immediately after formation of the coatings, the proportion of the acrylic resin must not be excessively high. Furthermore, for improving the electrophotographic properties, especially those found immediately after formation of the coatings, and to easily obtain high quality toner images, the proportion of the epoxy ester resin must not be too high. In accord with these, the resin compositions having mixing ratios in the coatings of the photosensitive layer as shown in Examples 1 through 7 gave apparently satisfactory results.

Further drying to initiate hardening was found to cause no problems in practical use, but rather improved more and more the properties of the coating of photosensitive layer in the respective Examples. But, in formulations containing higher proportions of the epoxy ester resin, a tendency toward an increase in the optical fatigue due to pre-exposure was observed.

EXAMPLE 8

The same photosensitive composition as in Example 4 was used except that instead of zinc oxide a rutile-type titanium oxide was used. The other conditions were the same as in Example 4.

The following results were obtained: $V_O^D = -350$ volts; $V_{60}^D/V_O^D = 0.81$; $(V_O^D)_H - 280$ volts; and $V_O^L/V_O^D = 0.87$. Other test results also were satisfactory as in Example 4.

EXAMPLE 9

In the photosensitive composition as described in Example 5 the resin formulation was varied as follows (with the proviso that the acrylic resin: epoxy ester resin ratio was the same as in Example 5): Acrylic resin: 50% varnish of styrene (20 parts by weight)-n-butyl acrylate (25 parts by weight)-2-hydroxyethyl methacrylate (5 parts by weight)-maleic anhydride (1 part by weight) tetrapolymer in a mixture of toluene/isopropyl alcohol (80/20 by volume). Epoxy ester resin: 50% solution of soybean oil-modified "Epicosol 805X" ® (manufactured by Nippon Coating Co., Ltd.) having an oil length of 42% in xylene.

A coating film was formed under the same conditions as in the previous Examples and a measurement of the various properties was conducted. Satisfactory results as in Example 5 were obtained.

While the invention has been described in detail and with reference to specific embodiments thereof, it will be apparent to one skilled in the art that various changes and modifications can be made therein without departing from the spirit and scope thereof.

What is claimed is:

1. A material to be marked and machined comprising a conductive base having coated thereon an electrophotographic photosensitive layer comprising finely divided photoconductive powders and a resin binder consisting essentially of a mixture of an acrylic resin and an epoxy ester resin in a ratio by volume of the acrylic resin to the epoxy ester resin of about 10:90 to 70:30, wherein said acrylic resin is a copolymer of an acrylic acid alkyl ester or a methacrylic acid alkyl ester with at least one copolymerizable monomer selected from the group consisting of crotonic acid, acrylic acid, itaconic acid, maleic anhydride, a hydroxyalkyl acrylate or methacrylate, a dihydroxyalkyl acrylate or methacrylate, an aminoalkyl acrylate or methacrylate, a dialkylaminoalkyl acrylate or methacrylate, a glycidyl acrylate or methacrylate, or styrene.

2. The material of claim 1, wherein said photoconductive powders are powders of zinc oxide, titanium oxide, lead oxide, cadmium sulfide, zinc sulfide, cadmium sulfide-cadmium carbonate complex, cadmium selenide, a phthalocyanine pigment, an azo pigment or a quinacridone pigment.

3. The material of claim 2, wherein said photoconductive powders are powders of zinc oxide.

4. The material of claim 1, wherein said acrylic resin comprises an acrylic ester copolymer containing therein the following repeating unit

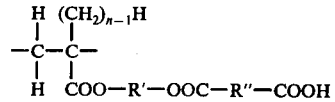

wherein $n$ is 1 or 2; R′ is a ($C_2$-$C_{10}$) alkylene group; and R″ is

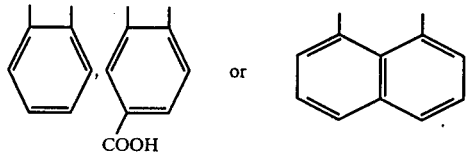

5. The material of claim 1, wherein said acrylic resin has a molecular weight of about 1,000 to 50,000 and a glass transition temperature ranging from about 10° to 100° C.

6. The material of claim 1, wherein said epoxy ester resin is an ester of an epoxy resin having at least two terminal epoxy groups with a fatty acid.

7. The material of claim 6, wherein said fatty acid is linseed oil fatty acid, dehydrated castor fatty acid, soybean oil fatty acid, castor oil fatty acid, coconut oil fatty acid or a vinyl monomer modified fatty acid.

8. The material of claim 6, wherein the proportion by weight of the fatty acid in the epoxy ester resin ranges from about 25 to about 70% by weight.

9. The material of claim 1, wherein the ratio by volume of said photoconductive powders to said resin binder ranges from about 25:75 to 80:20.

10. The material of claim 1, wherein the ratio by volume of the acrylic resin to the epoxy ester resin ranges from 15:85 to 60:40.

11. The material of claim 10, wherein the ratio by volume of the acrylic resin to the epoxy ester resin ranges from 20:80 to 50:50.

12. The material of claim 1, wherein said layer additionally contains a hardening catalyst for said acrylic and epoxy ester resin.

* * * * *